US006522087B1

(12) United States Patent
Lu

(10) Patent No.: US 6,522,087 B1
(45) Date of Patent: Feb. 18, 2003

(54) ULTRA-HIGH VOLTAGE IMPULSE GENERATOR

(76) Inventor: Chao-Cheng Lu, 4-4, Alley 27, Lane 143, Chun Kung Rd., Taipei 11614 (TW)

( * ) Notice: Subject to any disclaimer, the term of this patent is extended or adjusted under 35 U.S.C. 154(b) by 9 days.

(21) Appl. No.: 09/915,156

(22) Filed: Jul. 24, 2001

(51) Int. Cl.[7] ..... H05B 37/02
(52) U.S. Cl. ..... 315/291; 315/209 R; 315/360
(58) Field of Search ..... 315/291, 209 R, 315/360, 307, 224, 246, 247, DIG. 2, DIG. 5, DIG. 7, 308, 309

(56) References Cited

U.S. PATENT DOCUMENTS 4,882,663 A * 11/1989 Nilssen ..... 219/679
4,904,903 A * 2/1990 Pacholok ..... 315/209 R
5,920,469 A * 7/1999 Harvey ..... 323/901
5,942,859 A * 8/1999 Okude et al. ..... 315/209 R

* cited by examiner

*Primary Examiner*—Don Wong
*Assistant Examiner*—Chuc Tran
(74) *Attorney, Agent, or Firm*—Jacobson Holman PLLC

(57) ABSTRACT

The present invention relates to one or two more starters in a serial wiring on a ballast or autotransformer. An impulse high voltage is generated at the output of the ballast. Alternatively, by using a full wave bridge rectifier applied on the AC power source of the autotransformer and a group of diodes, high voltage capacitor, and a control circuit generates an inpulse high voltage at the output of the autotransformer. The invention can be used with high voltage ignition of discharge lamps and DC high voltage for industrial applications.

10 Claims, 8 Drawing Sheets

ULTRA-HIGH VOLTAGE IMPULSE GENERATOR

BACKGROUND OF THE INVENTION

For years, the Ignitor of Metal Halide Lamps and High Pressure Sodium Lamps are composed by SIDAC (Silicon Bi-directional Diode Thyristor) and Pulse Transformer. Because the limit of the Break-over Voltage of the SIDAC, it's hard to get a Voltage that are greater than 10 kV at the Secondary of the Pulse Transformer. This Invention applies my U.S. Pat. No. 5,583,395, Starter, and connect them in serial. The number of the Serial Starters is not limiting in this Invention. Therefore, an ultra high voltage is generated at the Secondary of the Ballast to apply on loads such like Discharge Lamps and High Voltage Loads. At the same time, if my new invention, a Controller Circuit, is applied on, this Invention will be more ideal. As my own experiment, it's very easy to get an Pulse Voltage that is greater than 100 kV.

SUMMARY OF THE INVENTION

1. AC Source: The AC Source of this Invention can be House outlet or Industrial power source, the Voltage and Frequency of the AC Source is not limiting.
2. Starter: The Starter of this Invention is the Starter in my patent, U.S. Pat. No. : 5,583,395. For physical application requirement, two parts of original Invention are applied on, Master Switch Circuit and Ignition Circuit, and are not limiting.
3. First Timer Control Circuit: Timer IC and several electronic circuits compose First Timer Control Circuit. The purpose of this circuit is to control the ignition time of the Invention; that is, all of the ignition timing is control by this Circuit.
4. Second Timer Control Circuit: Power Source Circuit, Timing Control Circuit, Switch Circuit, and Current Transformer Circuit compose the Second Timer Control Circuit.

Power Source Circuit: The purpose of this circuit is to supply Source to other circuit by transferred AC Source to DC source.

Timing Control Circuit: The main construction of the Timing Control Circuit is as same as the First Timer Control Circuit. The difference is that the control Transistor changes from NPN Transistor to PNP Transistor.

Switch Circuit: It is a Comparator Circuit that composed by OP AMP IC, Relay Circuit, and Photo Coupling Circuit. The purpose of this circuit is Ignition Controller.

Current Transformer Circuit: Current Transformer and Rectifier Circuit compose it. The purpose of this Circuit is to judge weather the Ignition is done or not and directly control to the Switch Circuit.

5. The Third Timer Circuit: Current Transformer Circuit, Rectifier Circuit, and OP AMP IC, and Photo Coupling Circuit compose the Circuit. The main function of this circuit is to control the ignition of this invention. It is an other option beside the First Timer Control Circuit and the Second Timer Control Circuit.

DETAILED DESCRIPTION OF THE PREFERRED EMBODIMENTS

Figure 1:
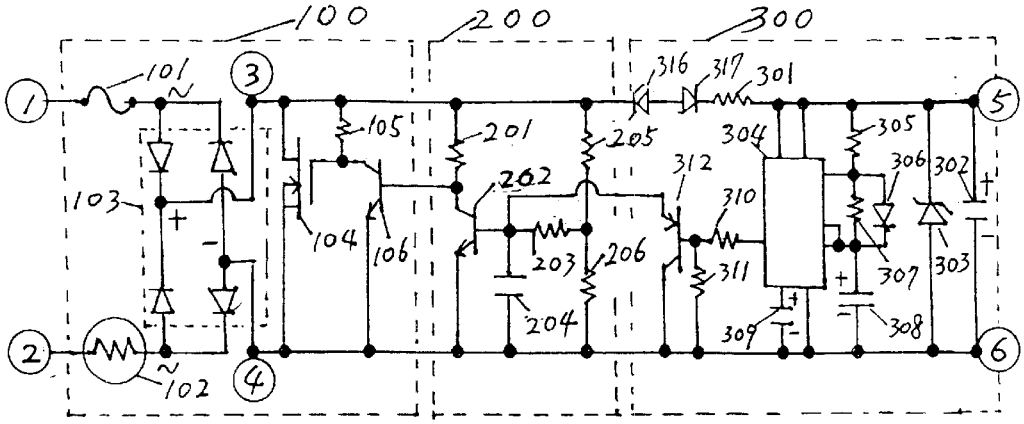
FIG. 1 shows the circuit diagram of the First Timer Control Circuit.

As shown in FIG. 1, the function theory of Master Switch Circuit 100 described as follow. When the AC Source input from Terminal 1, it sent through the Fuse 101 to the AC Terminal of Full Wave Bridge Rectifier 103 and the Positive Terminal of Full Wave Bridge Rectifier 103 connected to the Drain of MOSFET 104. The Negative Terminal of Full Wave Bridge Rectifier 103 is connected to the Source of MOSFET 104. When the MOSFET 104 turns on, the AC power is sent through the AC Terminal of Full Wave Bridge Rectifier 103 and PTC (Positive Temperature Coefficient Resistor) 102 to Terminal 2 to compose a AC Loop. Fuse 101 and PTC 102 is in serial circuit; therefore, the Fuse 101 and PTC 102 could be connected side by side no matter any position in this AC loop. Positive Terminal of Full Wave Bridge Rectifier 103, Terminal 3, and Negative Terminal of Full Wave Bridge Rectifier 103, Terminal 4 and Terminal 6, are connected to Master Switch Circuit 100, Ignition Circuit 200, and, the First Timer Control Circuit 300. Inverse Transistor 106 and Inverse Resistor 105 compose the Inverse Circuit of Master Switch Circuit 100. The Collector of Inverse Transistor 106 is connected to the Gate of MOSFET 104 and one junction of Inverse Resistor 105; the Emitter of Inverse Transistor 106 is connected to the Terminal 4; the Base of Inverse Transistor 106 is connected to the Collector of Transistor 202 in Ignition Circuit 200; and the other junction of Inverse Resistor 105 is connected to the Terminal 3, the Positive Terminal. Resistor 205, 206, Time Constant Coefficient Resistor 203, Capacitor 204, ignition Inverse Transistor 202, Inverse Resistor 201 composes Ignition Circuit 200. The Ignition waveform that scope from Terminal 1 and Terminal 2 is shown as FIG. 6A. The Time Constant Coefficient of Resistor 203 and Capacitor 204 and the act of the First Timer Control Circuit 300 give options of single pulse or multi oscillation pulses. The waveforms of the generated pulses are depended on applications and they are not limiting. The DC source of the First Timer Control Circuit 300 is sent from the serial circuit of Zener Diode 316, Diode 317, and Resistor 301; the Zener Diode 303 and the filter Capacitor 302 controls the voltage for the Timer IC 304. The timing of positive pulse output of Timer IC 304 is depended on Resistor 305 and Capacitor 308. The positive pulse output of Timer IC 304 is sent to divided Resistor 310 and Resistor 311. The center junction of Resistor 310 and Resistor 311 is connected to the Base of Transistor 312; at this moment the PNP Transistor 312 is turn off. The Emitter of the Transistor 312 is connected to the Base of the Ignition Transistor 202; the Collector of Transistor 312 is connected to Terminal 4. When the Timer IC 304 is in 0 Voltage output state, the Transistor 312 is turn on; the Base of Ignition Transistor 202 is shorted, Transistor 202 is in off state; that is, there is no ignition act between Terminal 1 and Terminal 2. The DC voltage of the Timer IC 304 can be measured from Terminal 5 and Terminal 6. Resistor 105, Ignition Resistor 201 and Divided Resistor 205 are connected to the Terminal 3. The Negative Terminal of Timing Coefficient Capacitor 204, Divided Resistor 206 and the other junction of Divided Resistor 311 are connected to the Terminal 4, Terminal 6. The junctions of Positive of IC 304, the N junction of Zener Diode 303, and the Positive of Filter Capacitor 302 are connected to the Terminal 5. The junctions of the Negative of IC 304, P junction of Zener Diode 303, and the Negative of the Filter Capacitor 302 are connected to Terminal 6.

Figure 2:
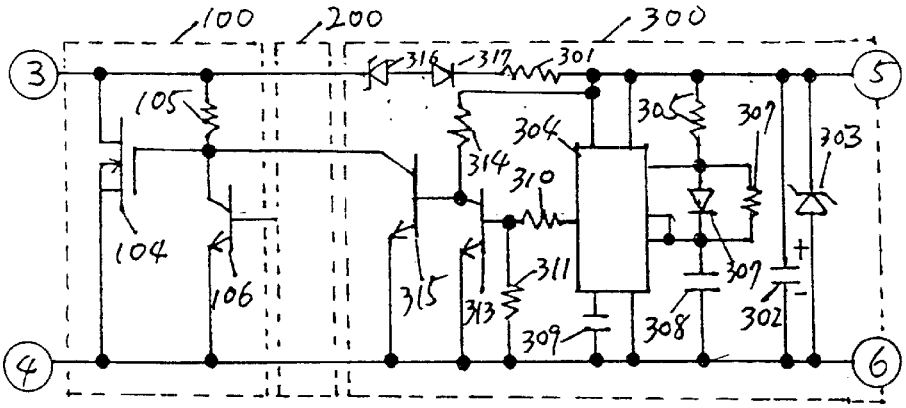
FIG. 2 shows the other circuit diagram of the First Timer Control Circuit.

The Differences between FIG. 2 and FIG. 1 are follows. The Positive pulses output of Timer IC 304 is sent to Divided Resistor 310 and 311; and the center junction of Resistor 310 and 311 is connected to the Base of the first control Transistor 314. The Collector of Transistor 313 is connected to the Base of the second control Transistor 315. At this moment the Transistor 315 is turn Off. The Collector of Transistor 315 is connected to the Gate of the MOSFET 304 of the Master Switch Circuit 100. The Emitters of First control Transistor 314 and the second control Transistor 315 are connected to the Terminal 4. The other junction of the Control Resistor 314 is connected to Terminal 5. The other action function is as same as FIG. 1.

Figure 3:
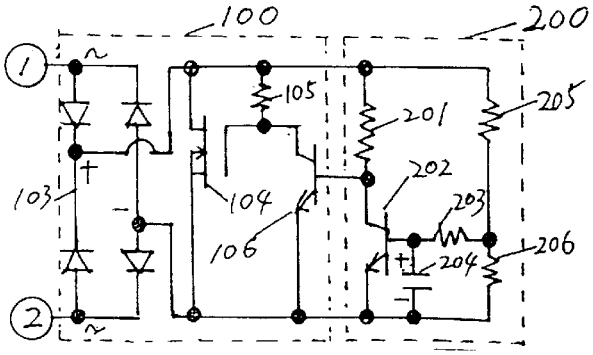
FIG. 3 shows the Starter circuit diagram using the invention of Master Switch Circuit and Ignition Circuit.

For the requirement of application, FIG. 3 show the Master Switch Circuit 100 and Ignition Circuit 200 is taken from FIG. 1 as an independent Circuit. This Circuit is called the First Simplified Ignitor.

For the requirement of application, FIG. 3 show the Master Switch Circuit 100 and Ignition Circuit 200 is taken from FIG. 1 as an independent Circuit. Because the AC input of the Invention is sent through Full Wave Bridge Rectifier 103, the Inverse Circuit of the Master Switch Circuit 100 can be saved. Therefore the Collector of Transistor 202 of Ignition Circuit 200 is connected to the Gate of MOSFET 104. The other action function is as same as FIG. 1.

Figure 4:
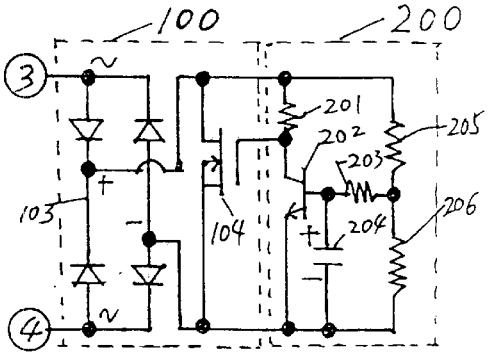
FIG. 4 shows the simplified Starter circuit diagram of FIG. 3 from Master Switch Circuit.
Figure 5:
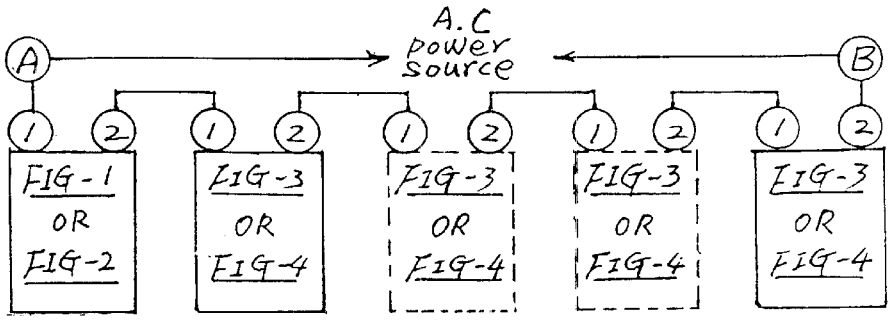
FIG. 5 shows the circuit diagram, which put FIG. 1, FIG. 2, FIG. 3 or FIG. 4, in serial.

FIG. 5 shows the application circuit of FIG. 1 (FIG. 2), FIG. 3 (FIG. 4) which connected in serial. The serial number of FIG. 3 (FIG. 4) is depended on how high the application required. The more FIG. 3 (FIG. 4) circuit in serial the higher pulses are gets; the waveform is shown in FIG. 6B.

Figure 6:
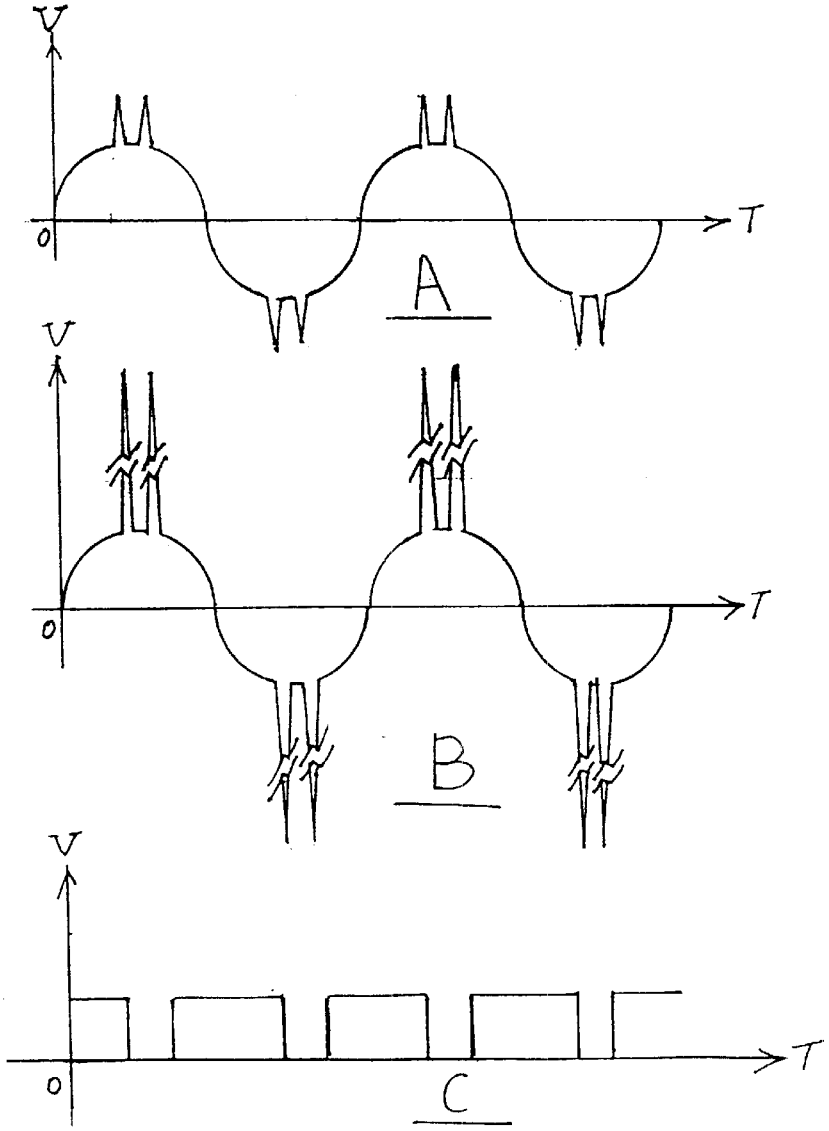
FIG. 6 shows the act function waveform connection between ignition Voltage of one Starter, numbers of Starters, and the control pulses of the Second or the Third Timer Control Circuit diagram.

FIG. 6 shows the action function theory of this Invention. FIG. 6C shows the output waveform of Timer IC 304 of the First Timer Control Circuit 300. FIG. 6B shows the output waveform of the A Terminal and B Terminal of FIG. 5. FIG. 6A shows the waveform of Terminal 1 and Terminal 2 of FIG. 1.

Figure 7:
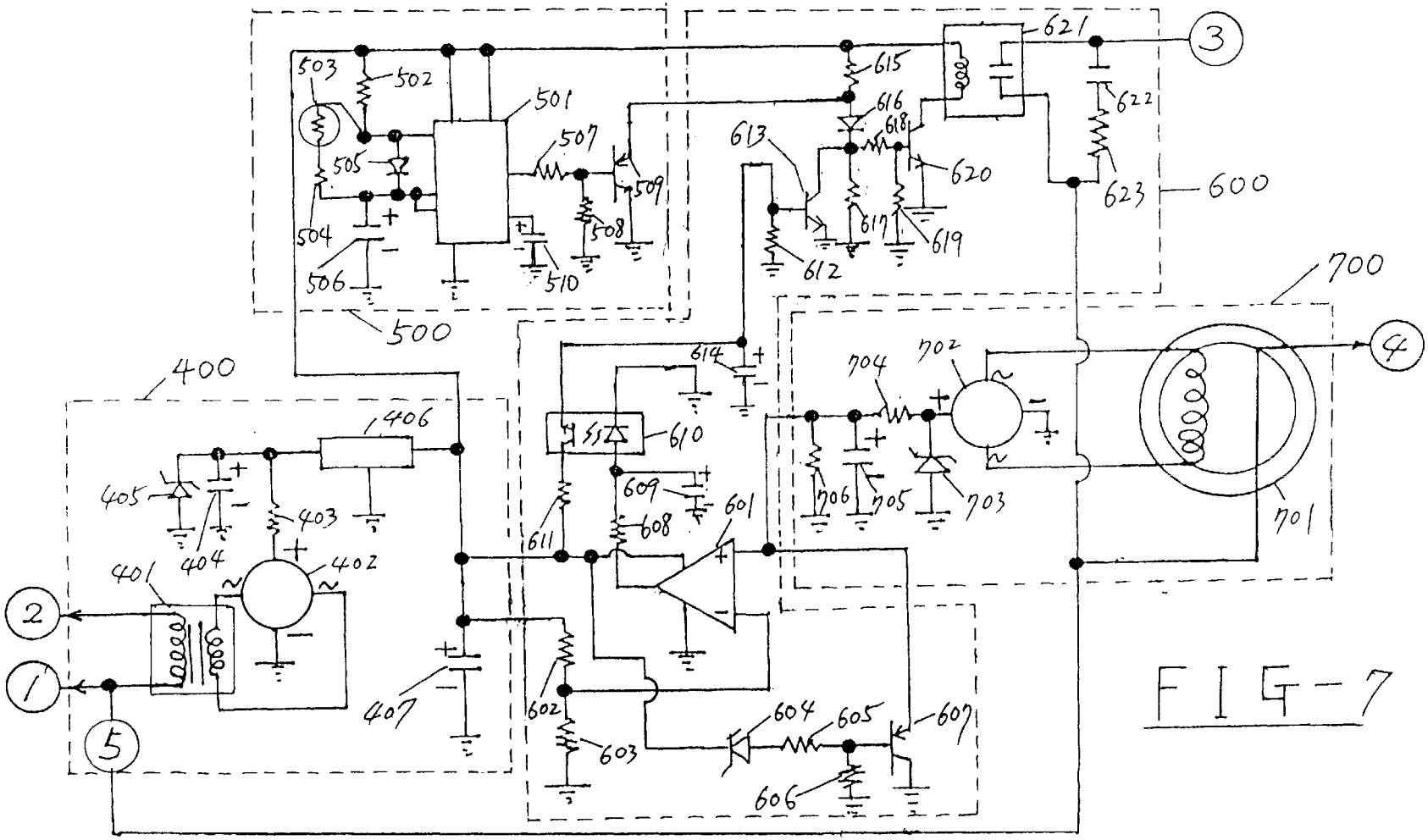
FIG. 7 shows the circuit diagram of the Second Timer Control Circuit.

FIG. 7 shows the Second Timer Control Circuit. Power Source Circuit 400, Timer Control Circuit 500, Switch Circuit 600, and Current Transformer Circuit 700 compose the Second Timer Control Circuit. The Input Terminal of Power Source Circuit 400 is the Primary of Transformer 401, Terminal 1 and Terminal 2. The Secondary of the Transformer 401 is connected to the two AC Terminal of Full Wave Bridge Rectifier 402; the Positive Terminal of Full Wave Bridge Rectifier 402 is connected to one junction of the Step-down Resistor 403. The other junction of Resistor 403 is connected to the Input Terminal of Voltage Regulator IC 406, the Positive Terminal of the first Filter Capacitor 404, and the N junction of Zener Diode 405. The Output Terminal of the Voltage Regulator IC 406 is connected to the Positive of the Second Filter Capacitor 407. The Negative Terminal of Full Wave Bridge Rectifier 402 is connected to the Negative Terminal of the First and the Secondary Filter Capacitor 404 and 407, P junction of the Zener Diode 405, and the Ground Terminal of the Voltage Regulator IC 406 as a common ground. After the AC Source from the Secondary of the Source Transformer 401 is sent through the Full Wave Bridge Rectifier 402, the DC output of the Full Wave Bridge Rectifier 402 is sent to the Input Terminal of Voltage Regulator IC 406, N junction of Zener Diode 405 and the Positive Terminal of the First Filter Capacitor 404 via Resistor 403. The Input Voltage of Voltage Regulator IC 406 is equal to the voltage across the Zener Diode 405. The Output Voltage of the Voltage Regulator IC 406 is the DC Power Supply of the Second Timer Control Circuit. The action theory of Timer Control Circuit 500 is the same as the First Timer Control Circuit. The only difference is that a PTC 503 is connected to the Turn-off Timer Coefficient Resistor 504 in serial. The purpose of the PTC 503 is when the Temperature of the Invention rises; the Ignition action has enough time to stop ignition. The DC Power Supply of the Invention Timer Control Circuit is supplied from Power Source Circuit 400. A Compapator Circuit that composed by OP AMP IC 601 in Switch Circuit 600 executes the comparison between two input voltages. When the DC Voltage on Non-inverter Terminal is greater than the DC Voltage on Inverter Terminal in the Comparator Circuit 601, the output of the Comparator Circuit 601 generates a DC Voltage. The DC Voltage from the output of the Comparator Circuit 601 is sent to the LED Terminal of Photo Coupling IC 610 via Step-down Resistor 608 and Filter Capacitor 609. At this moment the LED of Photo Coupling IC 610 is on, the Transistor of Photo Coupling IC 610 is in on state. The DC Voltage is sent to the Positive Terminal of Filter Capacitor 614, the Base of Control Transistor 613, and one junction of Base Resistor 612 via Resistor 611. The Collector and the Emitter of the Control Transistor 613 is in on State. Therefore the DC Voltage that sent to the Diode 616 via Resistor 615 is short-circuited by the Collector and Emitter of the Control Transistor 613. At this moment, the Voltage that sent to the Divided Resistor 618 and 619, and Resistor 617 can not make a Voltage on the Base of Switch Transistor 620 to turn the Collector and the Emitter of the Switch Transistor in Turn-off State. That is, the Coil of the Relay 621, which is connected to the Collector of Switch Transistor 620 in serial, is not activated. The Junction of the Relay 621 is in off State; the Ignition is stop. In contrast, if the Inverter Voltage is greater than Non-inverter Voltage in Comparator Circuit 601, the Invention executes the Ignition. The Voltage of the Inverter Terminal in Comparator Circuit 601 samples. from the center junction of Divided Resistors 602 and 603. The Voltage of the Non-inverter Terminal in Comparator Circuit 601 samples from the Secondary of Current Transformer Circuit 700. A Protection Circuit is connected to the Non-inverter Terminal of Comparator Circuit 601. The purpose of this Protection Circuit is to ensure that the Ignition is not executed if the DC voltage is not stable in the beginning power supply. A PNP Type Transistor 607, Divided Resistors 605 and 606, and Zener Diode 604 compose the Protection Circuit. The Primary of the Current Transformer Circuit 700 is serial to the Load. When an AC Power adds on the Load, a current is sent to the Primary of the Current Transformer Circuit 700; the Secondary of the Current Transformer Circuit 700 generates an AC Voltage. The AC Voltage is sent to the AC Terminals of the Full Wave Bridge Rectifier 702. A DC Voltage is got from the Positive Terminal of the Full Wave Bridge Rectifier 702 via the N junction of the Zener Diode 703, Divided Resistors 704 and 706, and the Positive Terminal of the Filter Capacitor 705. The Voltage, which sent to the Switch Circuit 600, is from the Center Junction Voltage of Divided Resistor 704 and 706. The Negative Terminal of the Full Wave Bridge Rectifier 702, the P Junction of Zener Diode 703, the Negative Terminal of the Filter Capacitor 705, and the other junction of the Resistor 706 is connected to the Common Ground. The function of this Division is that when the AC Voltage is not added on the load, the Division is 0 Voltage output. The Contact Point of Relay 621 of Switch Circuit 600 execute Turn-on action, the Ignition begins. When the Ignition successful, the Load Current makes the Switch Circuit 600 change state; at this moment the Relay is in Off State and stops the Ignition. The purpose of Timer Control Circuit 500 is to execute the Ignition Timing and the frequency of the Ignition action.

Figure 8:
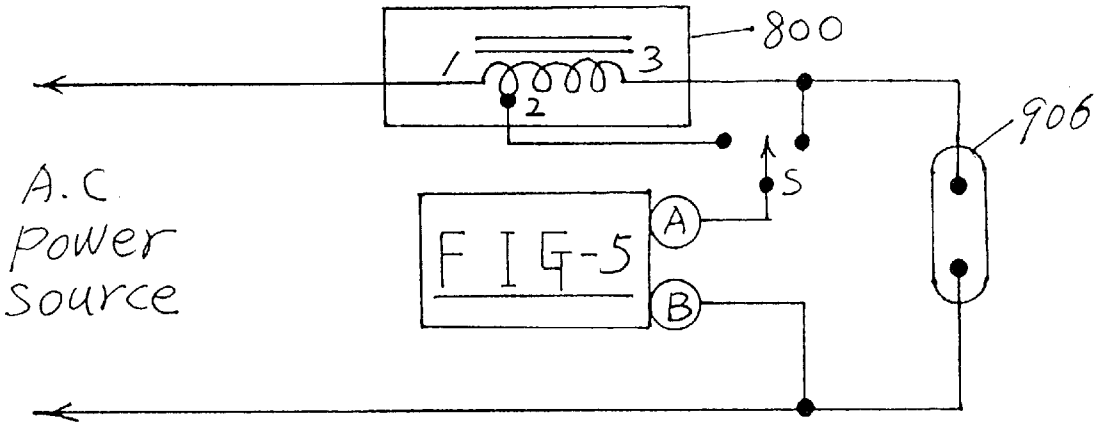
FIG. 8 shows the ignition application circuit diagram of FIG. 5.

FIG. 8 shows an application example of FIG. 5. The Input Terminal of the Ballast 800 is connected to the AC Power Source; the other Terminal of the Ballast 800 is connected to one Terminal of Discharge Lamp 906. The other Terminal of Discharge Lamp 906 is connected to the AC Power Source and Terminal B of FIG. 5. Terminal A of FIG. 5 can be connected to either the Tapping of Ballast 800 or the Output Terminal of Ballast 800 by Switch S and depended on application requirement and not limiting.

Figure 9:
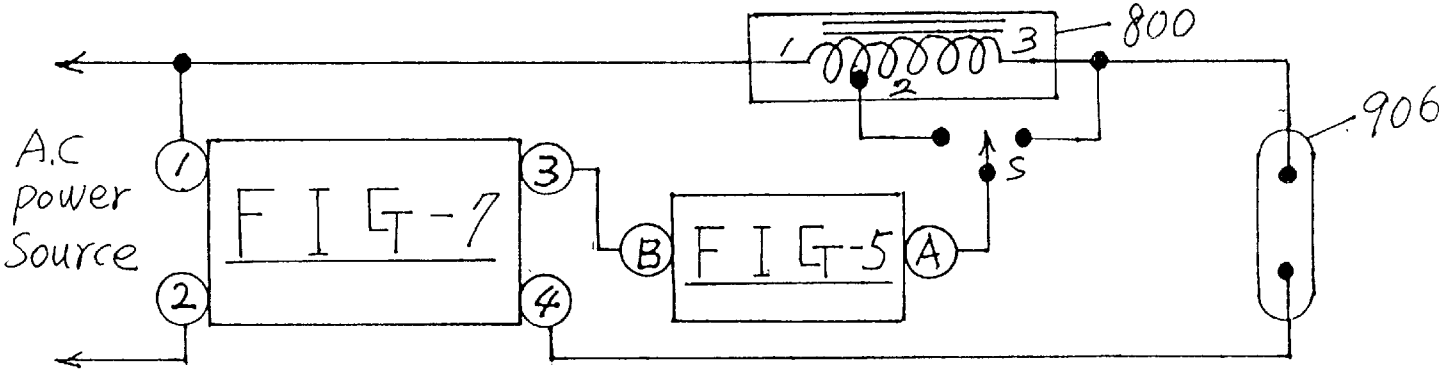
FIG. 9 shows the ignition application circuit diagram of a combination of FIG. 5 and FIG. 7.

FIG. 9 shows the application example of FIG. 7 and FIG. 5. the Input Terminal of Ballast 800 is connected to the AC Power Source, the Output Terminal of the Ballast 800 is connected to the Discharge Lamp 906. One Terminal of Discharge Lamp 906 is connected to the Terminal 4 of FIG. 7. Terminal A of FIG. 5 can be connected to either the Tapping of Ballast 800 or the Output Terminal of Ballast 800 by Switch S. The Terminal B of FIG. 5 is connected to the Terminal 3 of FIG. 7. The Terminal 1 and Terminal 2 of FIG. 7 are connected to the AC Power Source.

Figure 10:
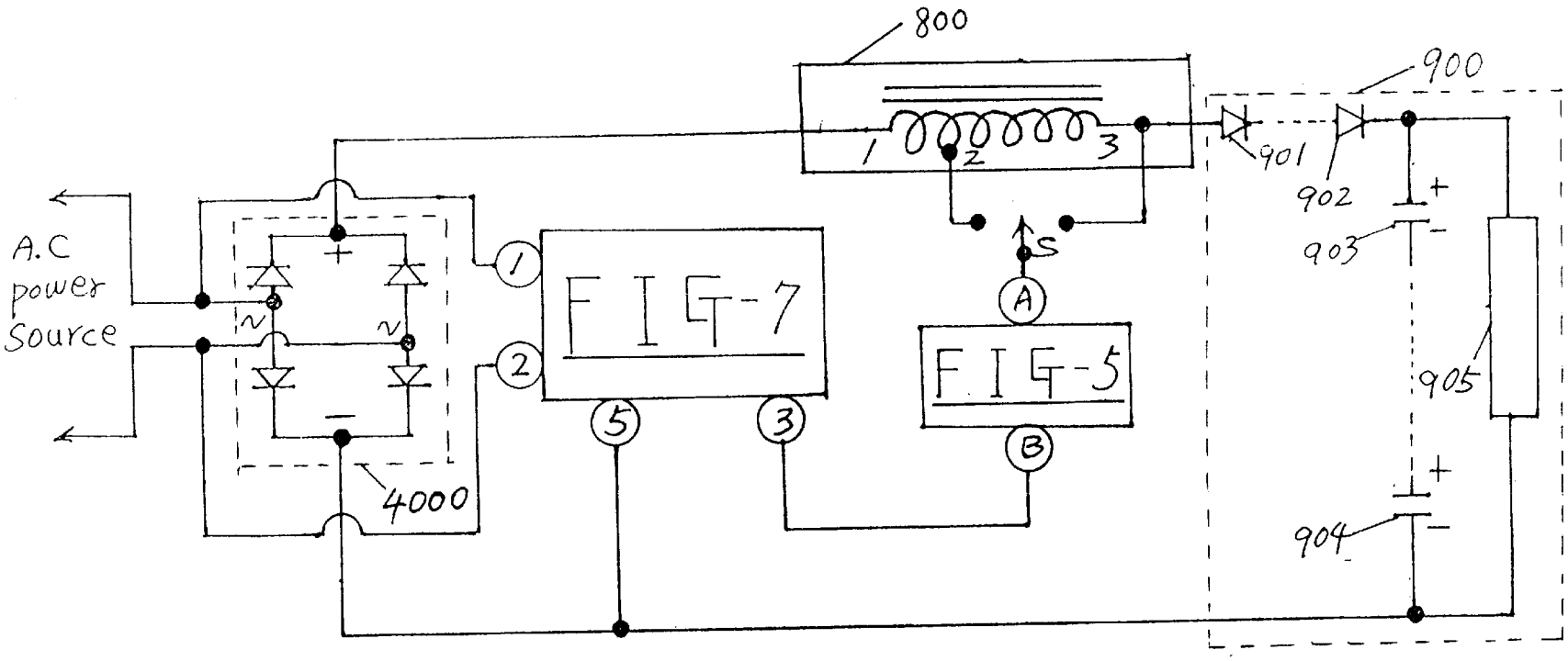
FIG. 10 shows that high DC voltage circuits diagram which come from the combination of FIG. 5 and FIG. 7.

FIG. 10 shows the application circuit of High DC Voltage Power Supply. The AC Source is connected to the AC Terminals of the Full Wave Bridge Rectifier 4000. The Positive of the Full Wave Bridge Rectifier 4000 is connected to the Input Terminal of Autotransformer 800; the Negative of the Full Wave Bridge Rectifier 4000 is connected to the Terminal 5 of FIG. 7 and common ground of Load Circuit 900. The Terminal 1 and Terminal 2 of Autotransformer 800 compose the Primary of Autotransformer 800; and Terminal 2 and Terminal 3 of the Autotransformer 800 compose the Secondary of Autotransformer 800. The Terminal A of FIG. 5 is connected to the Switch S. The Switch S switches to either Terminal 2 or 3 of Autotransforner 800 depended on application requirement. The Terminal 3, the Output Terminal of Autotransformer 800 is connected to the High Voltage Diode 901 and 902 of the Load Circuit. Other High Voltage Diode may connect between High Voltage Diode 901 and 902 in serial and same direction. The number of the High Voltage Diode is depended on the DC Voltage of the Load Circuit 900 and not limiting. The number of Capacitors that connected between the Filter Capacitors 903 and 904 in same direction serial and is depended on the characteristic of Load 905. The Terminal B of FIG. 5 is connected to the Terminal 3 of FIG. 7; Terminal 5 of FIG. 7 is connected to the Common Ground; Terminal 1 and Terminal 5 of FIG. 7 is separated.

Figure 11:
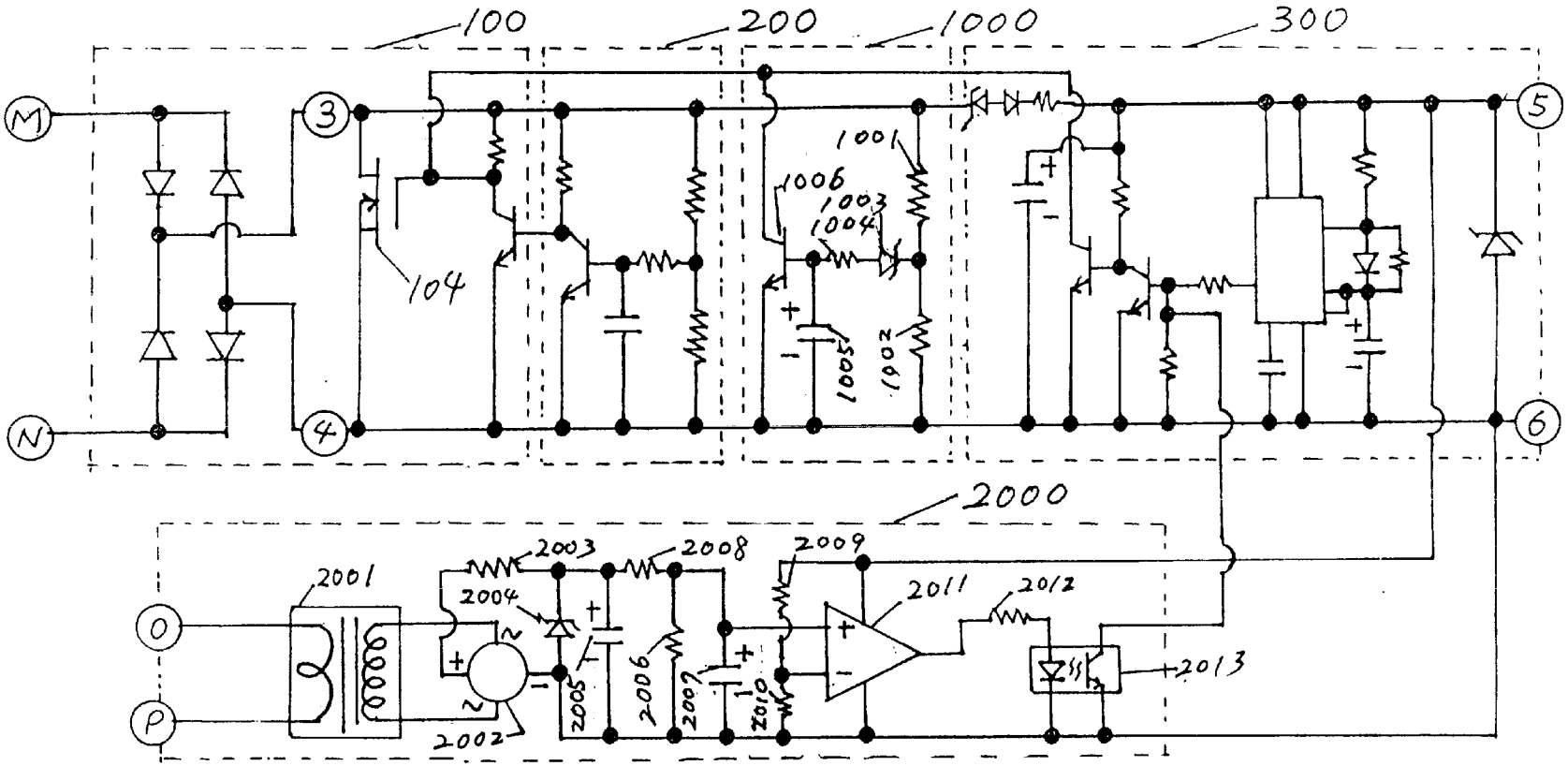
FIG. 11 shows a Auto-Reset circuit is added to FIG. 1 and connected to the Third Timer Control Circuit.

FIG. 11 shows the circuit diagram of the Third Timer Control Circuit. The Terminal O and the Terminal P is input terminal of Current Transformer 2001. When a AC Voltage is sent to the Terminal O and P, the Secondary of Current Transformer 2001 senses a AC Voltage and sends to the AC Terminal of Full Wave Bridge Rectifier 2002. The Positive Terminal is connected to the one junction of Step Down Resistor 2003; and the other junction of Resistor 2003 is connected to the N Junction of Zener Diode 2004, the Positive Terminal of Filter Capacitor 2005, and one junction of Divided Resistor 2008. The Center junction of Divided Resistors 2008 and 2006 is connected to the Positive Terminal of Capacitor 2007, and the Non-inverter Terminal of Comparator Circuit 2011. If the Non-inverter voltage is greater than Inverter voltage, the Comparator Circuit 2011 generates a Voltage Output. The Voltage Output from Comparator Circuit 2011 makes the LED of Photo Coupling IC 2013 on via Current Limiting Resistor 2012. The Collector and the Emitter of Photo Coupling IC 2013 are in Turn-On State; and make the Timer Control Circuit 300 in Off State. At this moment, the Master Switch Circuit 100 is in Off State. In Contrast, if the AC Voltage does not be sent to the Current Transformer 2001, the Inverter Voltage of Comparator Circuit 2011 is greater than the Non-inverter Voltage. At this moment, the Output State of the Comparator Circuit 2011 is 0 Voltage Output; the Transistor 315 of the Timer Control Circuit 300 is in Turn-off State; the Master Switch Circuit 100 is in Action State and start the Ignition Action. The Negative Terminal of Full Wave Bridge Rectifier 2002 is a Common Ground. P Junction of Zener Diode 2004, Negative Terminal of Capacitor 2005, one junction of Resistor 2006, Negative Terminal of Capacitor 2007, and the N Junction of the LED of the Photo Coupling IC 2013 are connected to the Common Ground. The Auto Reset Circuit 1000 gives this Invention another protection option. The Auto-Reset Circuit 1000 works whenever the Ignition takes place. The Time Coefficient Capacitor charges once whenever the Ignition executes once. When the Ignition exceeds the Safety Limit of the Circuit, the Voltage Level of the Capacitor 1005 turn the Collector and the Emitter of the Transistor 1006 in ON State; therefore the Ignition is stop because the Gate of the MOSFET 104 is grounded. This protection function keeps the MOSFET away from the burnout due to the Over Ignition. When the Voltage Level of the Capacitor 1005 goes down, the Ignition starts again. The working cycle like this certainly ensures the Safety of the MOSFET 104. Divided Resistors 1001 and 1002 are in Auto Reset Circuit 1000. The Center junction of Resistors 1001 and 1002 is connected to the N Junction of Zener Diode 1003; the P Junction of the Zener Diode 1003 is connected to one junction of the Time Coefficient Resistor 1004, the other junction of Resistor 1004 is connected to the base of the Transistor 1006 and the Positive Terminal of Capacitor 1005. The Collector of the Transistor 1006 is connected to the Gate of the MOSFET 104. The Emitter of the Transistor 1006, the Negative Terminal of Capacitor 1005, and the other junction of Resistor 1002 are connected to the Common Ground.

Figure 12:
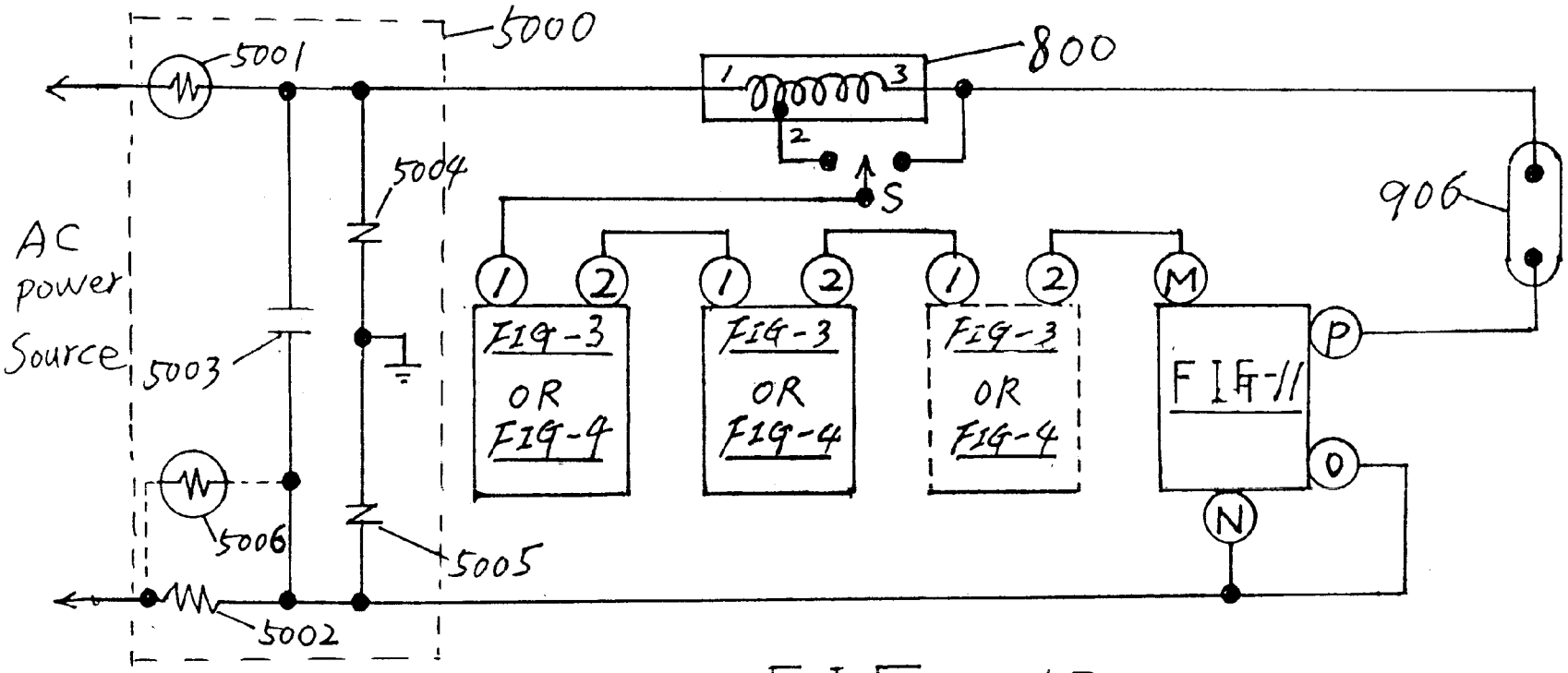
FIG. 12 shows an ignition application circuit diagram using a circuit of FIG. 11 and FIG. 1 (or FIG. 2), and FIG. 3 (or FIG. 4).

FIG. 12 shows the Application Circuit of a combination of FIG. 11 and FIG. 3 (FIG. 4). As shown in FIG. 12, one Terminal of AC Power Source is connected to the Input Terminal of Ballast 800 via PTC (Positive Temperature Coefficient Resistor) 5001; the Output of the Ballast 800 is connected to one terminal of Discharge Lamp 906. The Other Terminal of AC Power Source is connected to the Terminal O and N of FIG. 11 via Resistor 5002 or NTC (Negative Temperature Coefficient Resistor) 5006. The Terminal P of FIG. 11 is connected to the other terminal of Discharge Lamp 906. The Terminal M of FIG. 11 is connected to the Terminal 2 of FIG. 3 (FIG. 4). The Number of the FIG. 3 (FIG. 4) in serial is depended on the application and not limiting. The Terminal 1 of FIG. 3 (FIG. 4) is connected to the Switch S. the Switch S can be either switched to the Tapping Terminal or the Output Terminal of Ballast 800. The Terminal 1 and 2 of FIG. 3 (FIG. 4) are Non-Polarity as an AC characteristic. Therefore the Terminal 1 and 2 of FIG. 3 (FIG. 4) can be set in serial in any direction but not effect the result. For application, for the purpose of protecting the Discharge Lamp 906, several protections have been set. The PTC 5001 and Resistor 5002 or NTC 5006 are set in serial to the AC Power Source to protect the Short-circuit or Over Loading situation and limit the Start Current of the application circuit. A High Frequency Filter Capacitor 5003 is set to prevent the Noise that may occur in Discharge Lamp 906, Ignitor, and Timer Control Circuit. MOV (Mars-On Varistors) 5004 and 5005 are connected to the one junction of PTC 5001 and one junction of Resister 5002 or NTC 5006; the center junction of MOV 5004 and 5005 is connected to the Common Ground. The center junction, Common Ground, can be the Metal Case of the Invention or the Out Case of Ballast 800. The MOV 5004 and 5005 are set to prevent the Miss-Connection to the Power Source and Surge High Voltage. For extremely Surge High Voltage, the Filter Capacitor 5003 can be replaced by a SIDAC (Silicon Bi-Direction Diode Thyristor). The Resistor 5002 also can be replaces by PTC or NTC depended on application requirement. PTC 5001, Resistor 5002 or NTC 5006, Capacitor 5003, MOV 5004, and MOV 5005 compose A Letter Type Protection Circuit.

Figure 13:
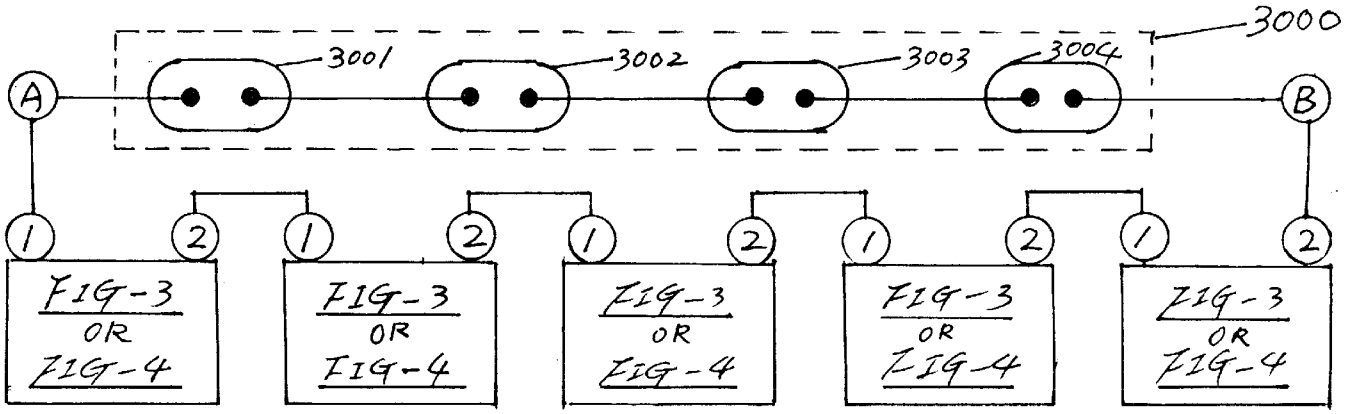
FIG. 13 shows the circuit composed by FIG. 3 or FIG. 4 which connect to the Surge Protectors Circuits in parallel.

FIG. 13 shows the Surge Protectors Circuits 3000 applies on a serial protection circuit to FIG. 3 or FIG. 4. The Surge Protector 3001, Surge Protector 3002, Surge Protector 3003, Surge Protector 3004 compose the Surge Protector Circuits 3000. The quantity of the Surge Protector that connected in serial is depended on the Break Down Voltage of the Surge Protector. The function of the Surge Protector is like the protection function of SIDAC or MOV to the power MOSFET. The Break Down Voltage of a serial numbers of power MOSFETs must be higher than the Break Down Voltage of a serial numbers of Surge Protectors. The IGBT (Insulated Gate Bipolar Transistors Modules) can be applied on this Invention instead of power MOSFET because both of them have the same characteristic.

Figure 14:
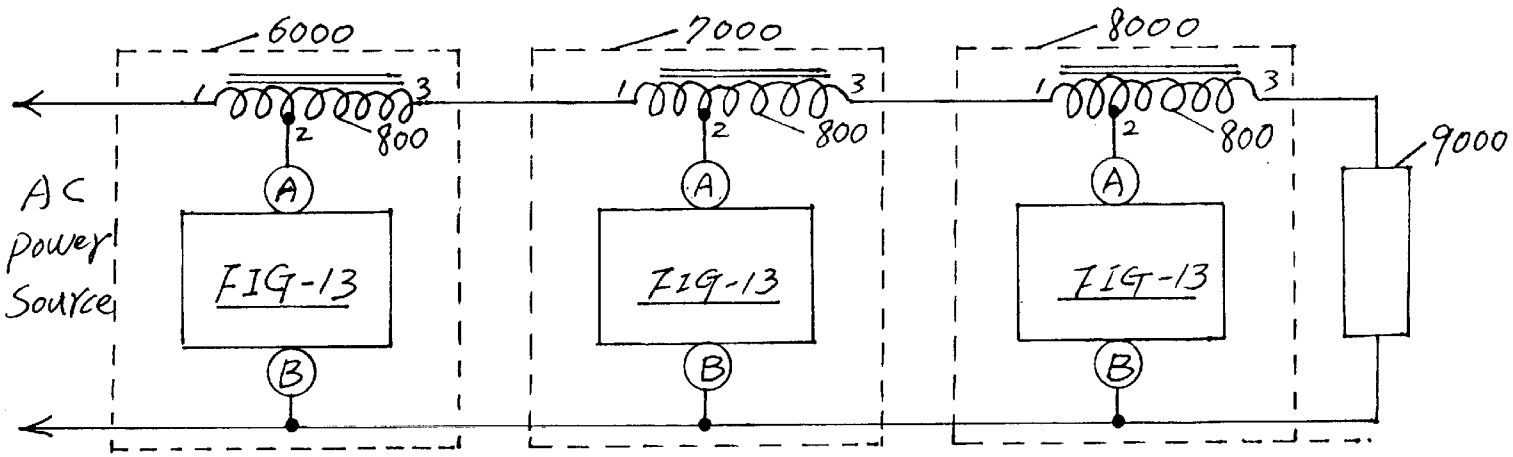
FIG. 14 shows the application example of FIG. 13.

FIG. 14 shows the application circuit of FIG. 13. There are three sets of circuits in this example. The connection circuit of Autotransformer 800 and the Terminal A and Terminal B. of FIG. 3 compose the First Set, 6000. The Terminal A of FIG. 13 is connected to the Topping Terminal of Autotransformer 800, Terminal 2. Terminal 1, Input Terminal, is connected to the Power Source. Terminal 3, Output Terminal, is connected to the Terminal 1 of the Second Set, 7000. The Terminal A of FIG. 13 is connected to the Terminal 2 of Autotransformer 800 of the Second Set, 7000. The Terminal 3 of Second Set, 7000 is connected to the Terminal 1 of the Third Set, 8000. The Terminal 2 of the Third Set, 8000 is connected to the Terminal A of FIG. 13. The Terminal 3 of the Third Set, 8000 is the Output Terminal, which connects to one terminal of High Voltage Load 9000. The other terminal of High Voltage Load 9000 is connected to the AC Power Source. The entire Terminal B of the three Sets is connected to each other. This Invention Application lists three Sets for the requirement of High Voltage Load 9000. The quantity of the Sets can be 1, 2, 3, or more and the quantity of Sets is not limited.

What is claimed is:

1. An ignition circuit comprising:

master switch circuit, ignition, and first timer control circuit;

fuse, PTC, full wave bridge rectifier, MOSFET, inverse circuit composed by inverse transistor and inverse resistor form the master switch circuit;

AC power source, fuse, PTC, and the AC terminals of full wave bridge rectifier are connected in serial;

a positive terminal of said full wave bridge rectifier is connected to a drain terminal of said MOSFET and one junction of inverse resistor, a negative terminal of said full wave bridge rectifier is connected to a source terminal of MOSFET and an emitter of the inverse transistor a collector of said inverse transistor is connected to a gate terminal of said MOSFET and another junction of said inverse resistor, a base of said inverse transistor is connected to the collector of the ignition transistor and one junction of resistor of the ignition circuit;

divided circuit, time coefficient resistor, time coefficient capacitor, ignition resistor, and ignition transistor form and ignition circuit;

two serial resistors compose divided circuit, one junction of said resistor is connected to a positive terminal of said full wave bridge rectifier, the one junction of resistor is connected to the negative terminal of full wave bridge rectifier, and a center junction of the divided resistors is connected to one junction of time coefficient resistor;

another junction of said time coefficient resistor is connected to a positive terminal of said time coefficient capacitor and a base of said ignition transistor, a negative terminal of said time coefficient capacitor is connected to the negative terminal of full wave bridge rectifier;

a collector of said ignition transistor is connected to one junction of ignition resistor and the base of inverse transistor, the emitter of ignition transistor is connected to a negative terminal of said full wave bridge rectifier, the base of the ignition transistor is connected to the positive terminal of said time coefficient capacitor, the other junction of said ignition resistor is connected to the positive terminal of full wave bridge rectifier;

the base of the ignition transistor is connected to the emitter of a PNP type transistor of the first time control circuit;

power supply circuit, timer IC circuit, and control transistor circuit form the first time control circuit;

power supply circuit is formed by a zener diode, forward action diode, step-down resistor, zener diode, and filter capacitor;

an N junction of said zener diode is connected to the positive terminal of said full wave bridge rectifier, a P junction of said zener diode is connected to the P junction of forward action diode, the N junction of said forward action diode is connected to the one junction of said step-down resistor, the zener diode, forward action diode, and step-down resistor are connected in serial, the other junction of said resistor is connected to the N junction of zener diode, positive terminal of filter capacitor, and the positive terminal of the timer IC, the P junction of zener diode, negative terminal of filter capacitor and the negative terminal of timer IC is connected to the negative terminal of said full wave bridge rectifier;

timer IC circuit is a standard astatic with independently controllable timing periods circuit, the output terminal of the timer IC is connected to the one junction of divided resistor, the center junction of divided resistors is connected to the said base of control transistor, the other junction of resistor is connected to the negative terminal of said fill wave bridge rectifier; and control transistor is a PNP type transistor, the emitter of the transistor is connected to the base of the ignition transistor of ignition circuit, the base of transistor is connected to the center junction of divided resistors, the collector of transistor is connected to the negative terminal of full wave bridge rectifier, and consist of at least one of the following, fuse, thermal fuse, or semiconductor fuse.

2. The ignition circuit according to claim 1, wherein the output terminal of the timer IC circuit of said first time control circuit is connected to the divided resistors, the center junction of the divided resistors is connected to the base of the first control transistor, the collector of the first control transistor is connected to the base of the second control transistor and one junction of control resistor, the other junction of control resistor is connected to the N junction of zener diode, the collector of the second control transistor is connected to the gate terminal of MOSFET of the master switch circuit, and the emitters of the first and second control transistor is connected to the negative terminal of full wave bridge rectifier.

3. The ignition circuit according to claim 1, wherein the first simplified ignition circuit includes the master switch circuit and ignition circuit;

the second simplified ignition circuit saves the inverse transistor, inverse resistor of master switch circuit, the ignition transistor of the ignition circuit is connected to the gate of MOSFET of master switch circuit which composes a simplified ignition circuit without inverse circuit, the drain of the MOSFET is connected to the positive terminal of full wave bridge rectifier, and the source terminal of MOSFET is connected to the negative terminal of said full wave bridge rectifier, the two AC power source, fuse, PTC, and the AC terminal of said full wave bridge rectifier are connected as a serial circuit.

4. The ignition circuit according to claim 1, wherein power source circuit, time control circuit, switch circuit, and current transformer circuit form the second time control circuit;

the input terminal of said power source circuit is the primary of transformer, the secondary of the transformer is connected to the two AC terminal of said full wave bridge rectifier, the positive terminal of said full wave bridge rectifier is connected to one junction of the step-down resistor, the other junction of resistor is connected to the input terminal of voltage regulator IC, the positive terminal of the first filter capacitor, and the N junction of zener diode, the output terminal of the voltage regulator IC is connected to the positive of the second filter capacitor, the negative terminal of full wave bridge rectifier is connected to the negative terminal of the first and the secondary filter capacitor as a common ground;

the time control circuit is a standard astatic with independently controllable timing periods circuit, the output terminal of timer IC is connected to divided resistors, the center junction of the divided resistors is connected to the base of the PNP type transistor, the emitter of the transistor is connected to the input terminal of switch circuit, the collector of transistor and the other junction of resistor are connected to the common ground, a PTC is connected to the turn-off timer coefficient resistor in serial to make the off timing of the ignition circuit longer due to the over-heating of the application circuit;

switch circuit is composed by comparator circuit structured by OP AMP IC, photo coupling IC, relay circuit, and protection circuits;

the non-inverter terminal of the comparator circuit is connected to the output terminal of current transformer circuit and emitter of the transistor of the protection circuit, the inverter terminal of comparator circuit is connected to the center junction of divided resistors, the other junction of resistor is connected to the positive terminal of second filter capacitor via zener diode, the other junction of resistor is connected to the common ground, the output terminal of the comparator circuit is connected to the positive terminal of filter capacitor and the P junction of the LED of the photo coupling IC, the collector of the photo coupling IC is connected to a current limiting resistor, the other junction of resistor is connected to the common positive terminal, the emitter of the photo coupling IC is connected to the positive terminal of filter capacitor, base of control transistor, and one junction of base resistor, the collector of the control transistor is connected to the N junction of diode, one junction of collector resistor, and one junction of divided resistor, the P junction of diode is connected to the emitter of transistor of time control circuit, and one junction of current limiting resistor, the other junction of resistor is connected to the common positive terminal, the base of switch transistor is connected to the center junction of divided resistors, the collector of the transistor is connected to the coil terminal of the relay the other terminal of the coil is connected to the common positive terminal, the resistor and capacitor are connected in serial with contact point terminals of relay as a protection circuit;

the non-inverter terminal is connected to the emitter of the PNP type transistor of protection circuit, the base of the transistor is connected to the center junction of divided resistors, the one junction of resistor is connected to the P junction of zener diode, the N junction of the zener diode is connected to the common positive terminal, the collector of the transistor is connected to the common ground; and the primary of the current transformer circuit is an input terminal, the two terminals of the secondary are connected to the AC terminal of full wave bridge rectifier, the positive terminal of full wave bridge rectifier is connected to the N junction of zener diode and one junction of divided resistor, the center junction of divided resistors is connected to the filter capacitor and non-inverter terminal of comparator circuit, the P junction of zener diode, negative terminal of capacitor and the other junction of resistor are connected to the common ground, the connection of power source circuit, time control circuit, switch circuit, and current transformer circuit is by direct coupling.

5. The ignition circuit according to claim 1, further comprises auto-reset circuit, and current transformer control circuit forming the third time control circuit;

divided resistors, zener diode, time coefficient resistor, time coefficient capacitor, and control transistor compose auto-reset circuit;

one junction of divided resistor is connected to the positive terminal of full wave bridge rectifier of the master switch circuit, the other junction is connected to the common ground, the center junction is connected to the N junction of zener diode;

the N junction of zener diode is connected to the center junction of the divided resistors, the P junction of the zener diode is connected to the one junction of time coefficient resistor;

the one junction of time coefficient resistor is connected to the P junction of zener diode, the other junction of time coefficient resistor is connected to the positive terminal of time coefficient capacitor and base of the control transistor;

the negative terminal of the time coefficient capacitor is connected to the common ground;

the base of the control transistor is connected to the positive terminal of time coefficient capacitor, the emitter of the control transistor is connected to the common ground, the collector of the control transistor is connected to the gate of the MOSFET of the master switch circuit;

the time coefficient of resistor and capacitor of auto-reset circuit must be greater then the time coefficient of resistor and capacitor of ignition circuit;

the auto-reset and ignition circuit can be replaced with each other, wherein the ignition circuit can work as a function of auto-reset circuit, current transformer circuit, comparator IC circuit, and photo coupling IC circuit form the current transformer control circuit;

the primary of current transformer is connected to the load terminal of AC power source, the two terminals of secondary of current transformer are connected to the AC terminals of full wave bridge rectifier, the positive terminal of the full wave bridge rectifier is connected to one junction of step-down resistor, the other junction of step-down resistor is connected to the N junction of the zener diode, the positive terminal of the first filter capacitor, one junction of divided resistors, center junction of divided resistors are connected to the non-inverter terminal of comparator IC circuit and the positive terminal of the second filter capacitor, the other junction of divided resistors is connected to the negative terminal of the first and second filter capacitor, P junction of zener diode, the negative terminal of full wave bridge rectifier as a common ground; and the non-inverter terminal of comparator IC circuit is connected to the positive terminal of the second filter capacitor, the inverter terminal is connected to the one junction of divided resistors, the one junction of the divided resistors is connected to the positive power terminal of comparator IC circuit and positive terminal of the first time control circuit, the other junction of the divided resistors is connected to the ground terminal of comparator IC circuit and common ground, the output terminal of the comparator IC circuit is connected to the one junction of current limit resistor, the other junction of current limit resistor is connected to the P junction of the LED of the photo coupling IC, the N junction of the LED is connected to the common ground, the collector of the photo coupling IC is connected to the center junction of divided resistors of the output of the first time control circuit, and the emitter of the photo coupling IC is connected to the common ground.

6. An ignition circuit for a discharge lamp comprising ballast, ignition circuit, first or second simplified ignition circuit and a discharge lamp;

the ballast can be either a tapping type or non-tapping type, an input terminal of said ballast is connected to an AC power source and an output terminal is connected to one terminal of said discharge lamp, a terminal of said ignition circuit, first or second simplified ignition circuit can be switch to either an output terminal of said ballast or a tapping terminal of the ballast;

the ignition circuit, first or second simplified ignition circuit are serial connected;

there are two terminals after said ignition circuit, first or second simplified ignition circuit connected in serial, one terminal can be chosen to the tapping of the ballast or output terminal of ballast, the other terminal is connected to the other terminal of discharge lamp and AC power source, the type of discharge lamp can be metal halide lamp, high pressure sodium lamp, or other discharge lamps; and one terminal of the discharge lamp is connected to the output terminal of ballast and the other terminal is connected to the AC power source.

7. The ignition circuit according to claim 6, wherein said two terminals after ignition circuit, first or second simplified ignition circuit connected in serial, one terminal can be chosen to the tapping of the ballast or output terminal of ballast, the other terminal is connected to the relay junction of the second time control circuit; and one terminal of the primary of current transformer of current transformer circuit of the second time control circuit is connected to the other terminal of discharge lamp, the relay junction is connected to the one terminal of first or second simplified ignition circuit connected in serial, the other two terminals are connected to the AC power source, input terminal of ballast is connected to the AC power source, and the output terminal of the ballast is connected to the one terminal of discharge lamp.

8. A high DC voltage power supply device, comprises full wave bridge rectifier, auto transformer, transformer, a second time control circuit, ignition circuit, first or second simplified ignition circuit connected in serial, a group of high voltage diodes, a group of high voltage capacitors, and loads said full wave bridge rectifier includes four diodes, and acts as two AC terminals, positive terminal, and negative terminal, the two AC terminals are connected to the AC power source, the positive terminal is connected to the input terminal of auto transformer, and the negative terminal is connected to the common ground of the second time control circuit, the negative terminal of high voltage capacitor group, and the ground terminal of the load;

the primary of the auto transformer is connected to the positive terminal of full wave bridge rectifier, a common junction is found between the primary and the secondary of the auto transformer, the common junction is connected to the one terminal of ignition circuit, first or second simplified ignition circuit connected in serial, and the secondary is connected to the P junction of high voltage diodes group;

the two AC terminals of the second time control circuit are connected to the AC power source, the switch junction of the relay is connected to the connected one terminal of first or second simplified ignition circuit and the other switch junction or relay is connected to the negative of full wave bridge rectifier;

one terminal of ignition circuit, first or second simplified ignition circuit connected in serial is connected to the common junction of auto transformer, the other terminal is connected to the one switch junction of relay of the second time control circuit, high voltage diodes group are composed by several diodes connected in serial, the number of serial is dependent on the requirement of the load, the P junction of the high voltage diodes group is connected to the secondary of the auto transformer, the N junction of high voltage diodes group is connected to the positive terminal of the high voltage capacitors group and the load;

high voltage capacitors group are composed by several high voltage capacitors connected in serial, the number of serial is dependent on a requirement of the load, the total working voltage, the positive terminal of high voltage capacitors group is connected to the N junction of high voltage diode group and one terminal of load, the negative terminal of high voltage capacitors group is connected to the negative terminal of full wave bridge rectifier; and the load is set by applications and is connected to the high voltage capacitors group in parallel.

9. An ignition circuit of discharge lamp with AC input protection circuit, comprising a letter type protection circuit, a third time control circuit, first or second simplified ignition circuit, ballast, and discharge lamp;

PTC, resistor or NTC, capacitor or SIDAC, and MOV form a type protection circuit;

one terminal of AC power source is connected to the one junction of PTC, the other junction of PTC is connected to the one junction of filter capacitor and MOV;

the other terminal of AC power source is connected to one junction of resistor or NTC, the other junction of resistor is connected to the filter capacitor and MOV, two MOV are connected in serial, the center junction of them is connected to ground, the one junction of MOV is connected to the PTC and the other junction of MOV is connected to the resistor or NTC, and when the noise of said application circuit is small, the filter capacitor is replaced by SIDAC;

the input terminal of ballast is connected to the MOV of a letter type protection circuit, the output terminal of ballast is connected to the one terminal of discharge lamp, the tapping terminal of the ballast is connected to either the one terminal of first or second simplified ignition circuit or the input terminal of current transformer of third time control circuit;

the third time control circuit is connected to the first or second simplified ignition circuit in serial, that is, either one of the two AC terminal of the full wave bridge rectifier of master switch circuit of the third time control circuit is connected to the first or second simplified ignition circuit in serial, the number of serial is depended to the application requirement, one of the input terminal of current transformer of third time control circuit is connected to discharge lamp, the other input terminal is connected to the AC power source terminal of master switch circuit and one terminal of AC power source, the other AC power source terminal of master switch circuit is connected to the one terminal of the first or second simplified ignition circuit connected in serial;

the type of discharge lamp can be metal halide lamp, high pressure sodium lamp or other discharge lamps, the two terminals of discharge lamp are connected to the output terminal of ballast and the input terminal of current transformer of third time control circuit or one terminal of the first, second simplified ignition circuit connected in serial, and the connection is depended on requirement of said application; and the first or second simplified ignition circuit has a characteristic oftwo-terminal for switching to the tapping terminal or the output terminal of ballast.

10. A circuit that rises up the ignition voltage comprising one unit of the super high voltage ignition circuit is composed by autotransformer, surge protectors, and first or second simplify ignition circuit;

the two terminals of surge protectors circuit are connected to the two terminals of first or second simplify ignition circuit in parallel and the combination of the above two circuits becomes a two terminally characteristic, either one of the terminals connects to the topping of the autotransfomer, the other terminal connects to the power source, the input terminal of autotransformer connects to the other terminal of the power source, the output terminal of the autotansformer connects to the input terminal of the other unit of super high voltage ignition circuit or to the high voltage load, the quantity of the super high voltage ignition circuit is depended on the requirement of the high voltage load;

one unit of super high voltage ignition circuit has a three terminally characteristic;

the quantity of the surge protector circuit connected in serial is depended on the break down voltage;

the quantity of the first or second simplify ignition circuit connected in serial is depended on the requirement of the high voltage load;

the break down voltage of the first or second simplify ignition circuit does be higher than the break down voltage of the surge protector circuit; and the power MOSFETs of the first or second simplify ignition circuit can be replaced by IGBTs.

* * * * *